US005526600A

United States Patent [19]

Chesnut et al.

[11] Patent Number: 5,526,600

[45] Date of Patent: Jun. 18, 1996

[54] CARTRIDGE MAGAZINE CAPACITY EXTENDER

[75] Inventors: M. Gaines Chesnut, Hamilton; Dennis D. Sweet, Loma, both of Colo.

[73] Assignee: Blount, Inc., Montgomery, Ala.

[21] Appl. No.: 311,126

[22] Filed: Sep. 22, 1994

[51] Int. Cl.[6] ..... F41A 9/65

[52] U.S. Cl. ..... 42/50; 42/7

[58] Field of Search ..... 42/7, 18, 22, 50

[56] References Cited

U.S. PATENT DOCUMENTS

| | | | |
|---|---|---|---|
| 1,015,490 | 1/1912 | Harrington | 42/7 |
| 1,323,063 | 11/1919 | Johnson et al. | 42/50 |
| 3,453,762 | 7/1969 | Fremont | 42/50 |
| 4,343,107 | 8/1982 | Kaltenegger | 42/7 |
| 4,397,109 | 8/1983 | Pachmayr et al. | 42/50 |
| 4,514,922 | 5/1985 | Farrar et al. | 42/50 |
| 4,765,081 | 8/1988 | Dieringer | 42/50 |
| 5,293,708 | 3/1994 | Strayer et al. | 42/7 |
| 5,329,718 | 7/1994 | Howard | 42/50 |
| 5,341,586 | 8/1994 | Aluotto et al. | 42/7 |

FOREIGN PATENT DOCUMENTS

| | | | |
|---|---|---|---|
| 333250 | 2/1921 | Germany | 42/50 |
| 875222 | 8/1961 | United Kingdom | 42/50 |

*Primary Examiner*—Stephen C. Bentley
*Attorney, Agent, or Firm*—Sheridan Ross & McIntosh

[57] ABSTRACT

An extended capacity cartridge magazine assembly for containing and feeding cartridges to a firearm is disclosed. The magazine includes a metal body for containing cartridges having an upper outlet through which cartridges may exit the magazine into the firing chamber of the firearm and a base plate for covering the bottom of the magazine body. A follower body is disposed within the body of the magazine for biasing cartridges toward the upper outlet. The follower body and the magazine body have certain dimensions to prevent an unwanted amount of rotation of the follower body when 0.45 caliber cartridges are being used. A collar slidably movable along the length of the magazine body is adapted to retain the base plate in a fixed position with respect to the magazine body. A flexible bumper plate interconnects with the bottom surface of the collar to secure the cartridge magazine assembly.

17 Claims, 10 Drawing Sheets

CARTRIDGE MAGAZINE CAPACITY EXTENDER

FIELD OF THE INVENTION

The present invention relates to cartridge magazines for firearms and, in particular, to an extended capacity cartridge magazine for a 0.45 caliber firearm.

BACKGROUND OF THE INVENTION

Numerous firearms employ cartridge magazines for storing cartridges and for successively feeding cartridges into the firing chamber of the firearm. A cartridge magazine typically includes a body defining a chamber for storing cartridges and a mechanism to facilitate successively positioning cartridges within the firing chamber of the weapon. Cartridge magazines are normally purchased empty and must be loaded with cartridges by the consumer. In use, a loaded cartridge magazine is disposed within the well of a firearm and is securely engaged to the firearm using a releasable spring locking mechanism integral to the firearm. The magazine may be removed from the firearm for storage, reloading or other purposes by releasing the spring locking mechanism.

The firearm well of a Colt 0.45 caliber pistol defines a chamber within the grip of the pistol for receiving a cartridge magazine. The well of a 0.45 caliber pistol includes a spring biasing mechanism which urges the magazine out of the well and a releasable locking mechanism integral to the pistol for securely engaging the magazine within the well against the bias provided by the spring mechanism. In use, a loaded 0.45 cartridge magazine is manually inserted into the firearm well of the pistol and securely engaged to the firearm by the releasable locking mechanism. When inserting a magazine into the well of a firearm, a user must apply a force to the base of the magazine sufficient to overcome the resistance provided by the spring biasing mechanism. The magazine may be ejected from the pistol by releasing the locking mechanism, usually accomplished by pressing a button near the trigger of the pistol. Once the locking mechanism has been released the magazine is forcibly ejected from the well by the spring biasing mechanism.

A standard 0.45 caliber magazine holds seven cartridges and is dimensioned such that the base of the magazine is substantially flush with the base of the pistol's handle when the magazine is engaged in the well of the firearm. Most 0.45 caliber magazines include a spring-driven mechanism within the magazine body for successively positioning cartridges within the firing chamber of the pistol.

In certain instances, especially in sport or competition shooting, shooters may find it advantageous to use extended capacity cartridge magazines. It is therefore desirable to provide an extended capacity cartridge magazine for use with a firearm. In this regard it is known in the art to provide extended capacity cartridge magazines which hold more than the standard seven cartridge magazine. One such extended capacity magazine is illustrated in FIGS. 1–3. FIG. 1 is an exploded assembly view of an extended capacity magazine 10 for use with a 0.45 caliber pistol having a body 12 formed from steel or other like metal and a base 20 formed from a rigid plastic slidably engagable with the lower end of the body 12 by means of interfitting tongues 14, 14' located on the lower end of the magazine body 12 and corresponding grooves 22, 22' in base 20. The magazine body 12 is formed from a single piece of steel or other like metal welded along a vertical weld line 13 in the center of the back wall of the magazine body 12. Base 20 is securely attached to the body 12 by retaining plate 24, which is secured to base 12 using screw 26. When secured in place, retaining plate 24 holds magazine body 12 in a fixed position relative to base 20. As illustrated in FIG. 2, rigid plastic base 12 extends downwardly from the handle 32 of pistol 30 when the magazine 10 is engaged in the well 34 of the pistol 30. The extended length of magazine 10 allows the magazine 10 to hold nine cartridges instead of the standard seven cartridges.

Additionally, in competition or sport shooting it may be advantageous for a shooter to rapidly eject a spent magazine and replace it with a full magazine. In this case it is common for shooters to allow the empty magazine to drop to the ground after being ejected from the well to facilitate the rapid reloading of the firearm. A rigid plastic base, such as that employed in the extended capacity magazine of FIG. 1, is susceptible to cracking or other damage upon impact with a hard surface, as would occur when the magazine is ejected from the firearm onto the ground. This may require the shooter to incur the expense of purchasing a new magazine. It is therefore also desirable to provide an extended capacity magazine which is resistant to damage when ejected from the well and allowed to drop onto a hard surface.

It is known that existing cartridge magazines are prone to jamming or otherwise failing to smoothly feed the cartridges through the magazine body into the firing chamber of the firearm. This tendency is primarily attributable to two features of existing cartridge magazines. First, as illustrated in FIG. 3A, the follower body 28 of most prior art magazines has been designed having a geometry and dimensions which allow the follower body to rotate or pivot clockwise and/or counter-clockwise relative to an end wall of the magazine body 12. FIG. 3B illustrates the aspect of the follower body (in an exaggerated depiction) being able to move side-to-side within the magazine body. It has been discovered that permitting the follower body 28 to pivot or rotate as little as two or three degrees within the magazine body may inhibit the smooth feeding of cartridges through the magazine and result in cartridge jamming. Second, as illustrated in FIG. 3B, it is traditional to weld cartridge magazines along a vertical weld line 13 in the center of the rear wall of the magazine body. Because cartridges are typically canted at some angle with respect to the horizontal, only the top portion of the rim of each cartridge makes contact with the back wall of the magazine body. Further, because the cartridges are centered within the magazine body, the rims contact the magazine body directly in the center of the back wall. Although the weld line 13 is typically sanded and polished, some surface imperfections may remain along the weld line. The rims of the cartridges may catch on these surface imperfections, which may cause the cartridges to jam or otherwise fail to feed smoothly into the firing chamber, as illustrated in FIG. 3A. It is therefore also particularly desirable to provide a cartridge magazine which consistently feeds cartridges to the firing chamber without jamming.

SUMMARY OF THE INVENTION

It is an object of the present invention to provide an extended capacity cartridge magazine for use with a firearm which does not detract from the performance or aesthetics of the firearm.

It is also an object of the present invention to provide a cartridge magazine that resists damage when the magazine is ejected from the firearm and allowed to drop onto a substantially hard surface.

A further object of the present invention to provide a cartridge magazine for use with a firearm that is easy to assemble and disassemble and which allows for manufacturing efficiencies.

Still another object of the present invention is to provide a cartridge magazine which facilitates the smooth feeding of cartridges through the magazine body to the firing chamber of the firearm.

In accordance with the present invention a cartridge magazine is provided for housing and properly feeding cartridges to a firearm. The magazine of the present invention preferably includes a magazine body having an upper end including an outlet from which cartridges exit the body of the magazine into the chamber of the pistol and a lower end including a base plate opposite said upper outlet. A follower assembly is preferably utilized for moving cartridges relative to the body of the magazine. In addition, a spacer assembly is preferably disposed at the lower end of the magazine body.

More particularly, the magazine body includes a housing chamber for receiving and storing cartridges including an outlet at the upper end of said body through which cartridges may exit said housing chamber to enter the firing chamber of the firearm. The magazine body may be formed from steel or other like metal and may be welded along a vertical weld line preferably offset from the center of the back wall. First and second opposing guide tracks are preferably disposed at the lower end of said magazine body. A base plate preferably including first and second opposing ears defining first and second opposing channels may be slidably engagable with said first and second guide tracks for covering at least a portion of the bottom of said housing chamber.

The spacer assembly preferably includes a collar slidably movable along the length of said magazine body for disposition at the lower end of said magazine body and a connectable bumper plate. Advantageously, the bottom surface of the collar preferably includes first and second rims defining first and second gaps in substantial alignment with said first and second ears of said base plate. When the collar is positioned at the lower end of said magazine body, said first and second ears of said base plate are preferably disposed within said gaps, thereby forming a substantially continuous rim and underlying channel disposed on the bottom surface of said collar.

The bumper plate preferably includes an opposing perimeter rim and underlying channel dimensioned to facilitate the connection of the bumper plate to the magazine. The bumper plate may be connected to the magazine by interlocking the opposing rim and channel configurations disposed on said bumper plate and said collar. Connecting the bumper plate to the collar contributes to securing the collar and base plate in place with respect to the magazine body.

In one embodiment the present invention may be particularly adapted for providing a ten cartridge magazine for a 0.45 caliber pistol. This embodiment of the invention may include a magazine body including a slidably engagable base plate preferably formed from steel and dimensioned to fit within the well of a 0.45 caliber pistol and to receive up to ten 0.45 caliber cartridges. Advantageously, the magazine body may be welded along a vertical weld line preferably offset from the center of the back wall of the magazine body to facilitate the smooth feeding of cartridges through the magazine body. The follower assembly may be housed within the magazine body and preferably includes a follower body for contacting the first cartridge inserted into said chamber and a compression spring disposed between said follower assembly and said base plate for biasing cartridges toward the upper end of said magazine body. The follower body is preferably of a geometry and dimension which restricts the rotation of the follower body within the magazine body. In an alternative embodiment a constant force spring follower assembly may be used to bias cartridges toward the upper end of said magazine body.

The collar may be formed from a substantially rigid plastic and is preferably dimensioned to cover substantially the entire length of the magazine which extends beyond the well of the pistol when the magazine is engaged with the firearm. At least a portion of the upper surface of the collar is, in one embodiment, scalloped to avoid pinching the hand of the shooter when the magazine is inserted into the pistol; however, this could be a variety of shapes, including textured or ribbed. The collar may include one or more cavities for selectively receiving weighted objects to allow the user to balance the firearm. The side surfaces of the collar may also include one or more ribbed elements to facilitate gripping the collar. The bottom surface of the collar preferably includes a rim surface defining an underlying channel for interconnection with a bumper plate and having first and second opposing gaps for receiving the ears of the base plate.

The bumper plate is preferably formed from a flexible, shock absorbing polymer or rubber and also preferably includes a perimeter rim defining an underlying channel dimensioned to interlock with the rim and underlying channel disposed on the bottom surface of the collar. The bumper plate may be secured to the magazine by simply snapping the bumper plate over the bottom surface of the collar, thereby interlocking the opposing rims and channels disposed on the collar and the bumper plate. Engaged in this manner, the bumper plate contributes to securing the magazine as a single unit.

It should be apparent from the foregoing description that a further advantage of the present invention lies in the ease of assembly and disassembly of the magazine. The snap together design allows the magazine to be assembled without the need for tools, thereby resulting in manufacturing efficiencies. Furthermore, the snap-on design facilitates easy disassembly of the magazine by the user for routine cleaning and maintenance.

Other objects and advantages of the present invention will become apparent from the following description with reference to the accompanying figures.

DETAILED DESCRIPTION

There is hereinafter described a cartridge magazine assembly for housing and supplying cartridges to a firearm. The disclosed embodiment is particularly adapted to provide an extended capacity cartridge magazine assembly for a 0.45 caliber pistol. However, it should be appreciated that the magazine assembly of the present invention may be adapted to suit a wide variety of firearms.

Figure 1:
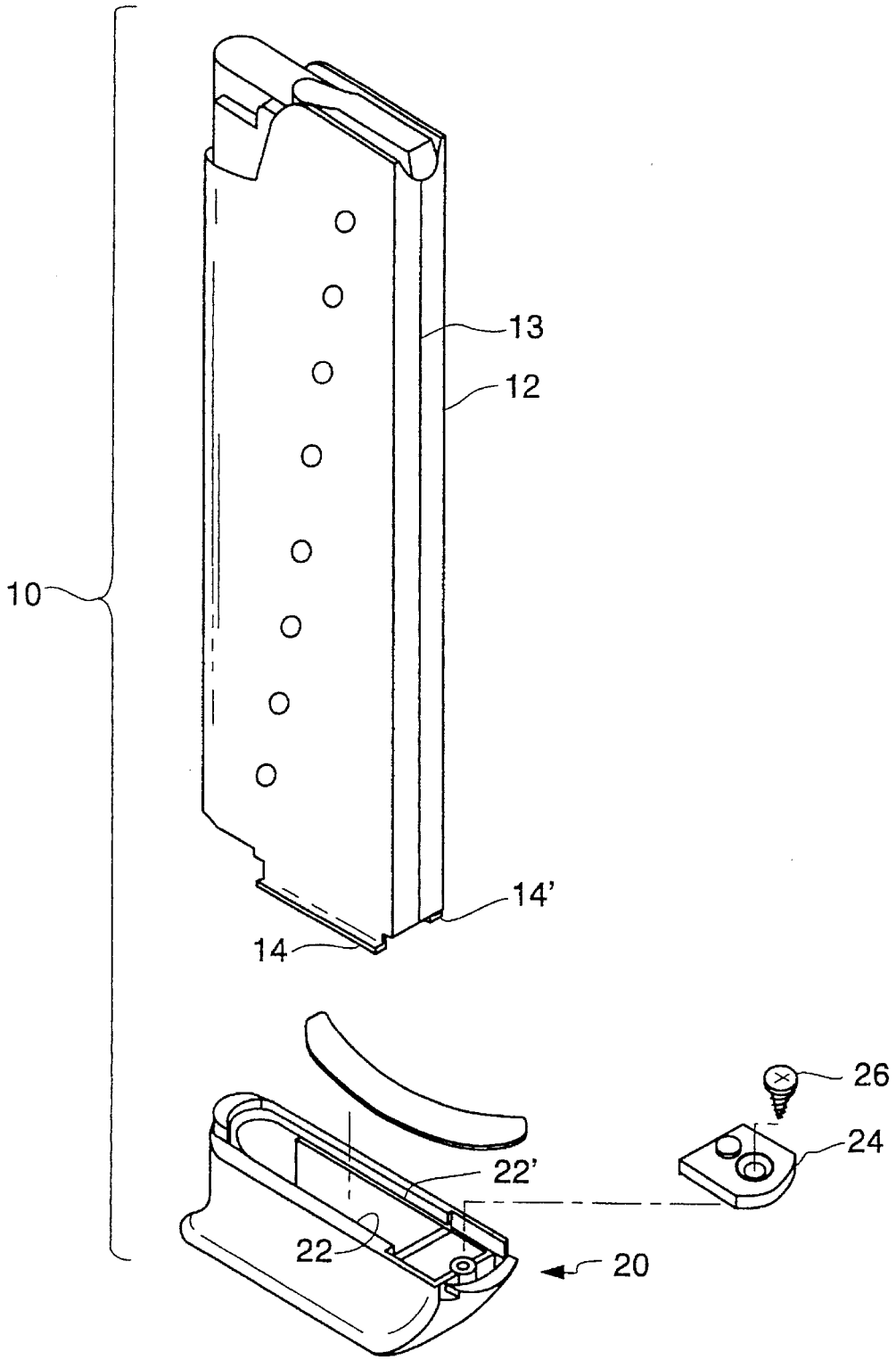
Fig. 1 (PRIOR ART)
FIG. 1 is an exploded assembly view of a prior art extended capacity cartridge magazine for a 0.45 caliber pistol.
Figure 2:
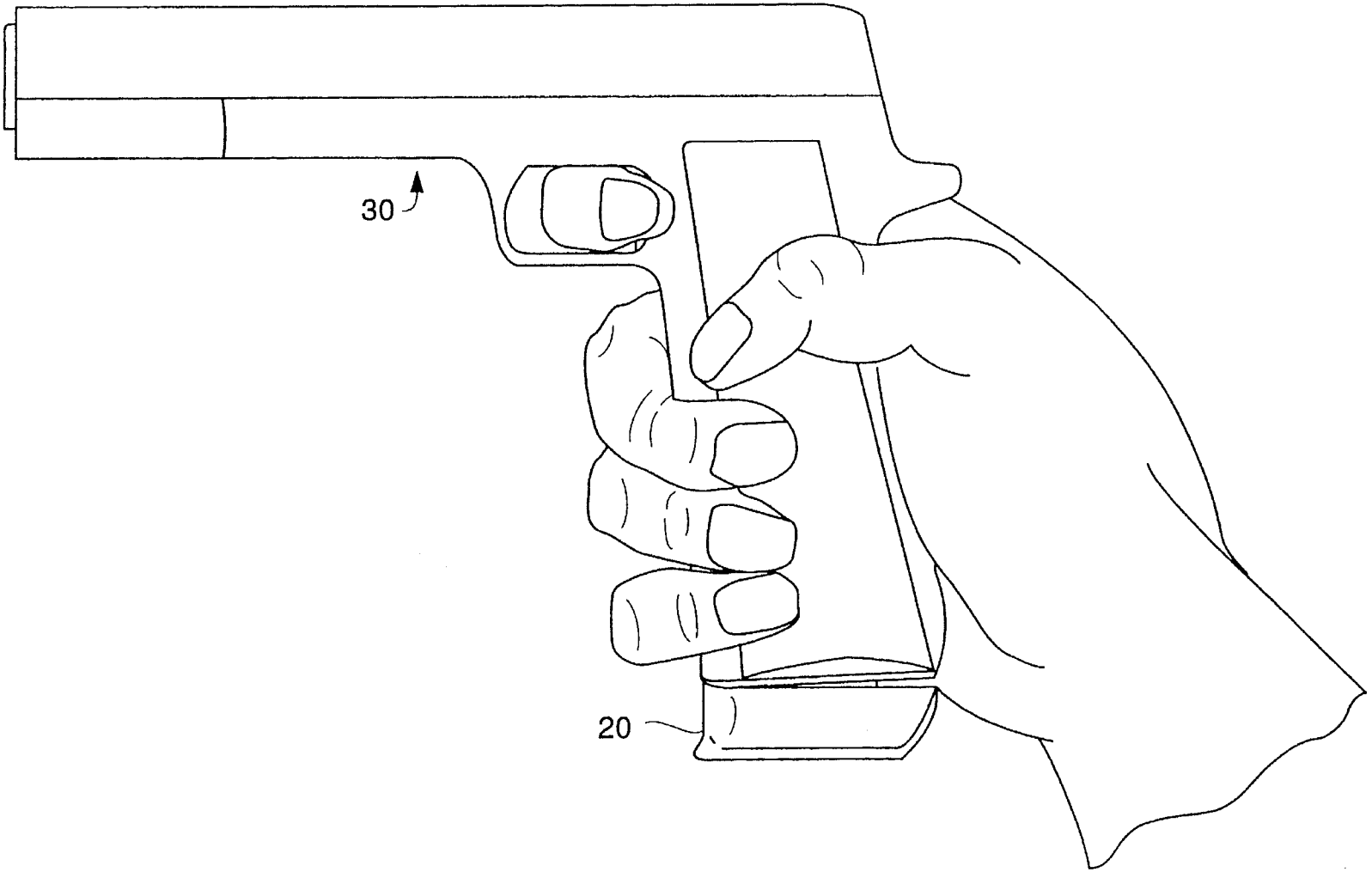
Fig. 2 (PRIOR ART)
FIG. 2 is a perspective view of a prior art extended capacity cartridge magazine engaged within the well of a 0.45 caliber pistol.
Figure 3B:
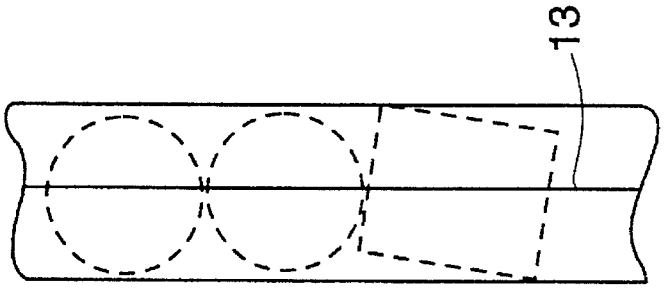
Fig. 3B (PRIOR ART)
FIG. 3B is a rear view of an existing extended capacity cartridge magazine.
Figure 3A:
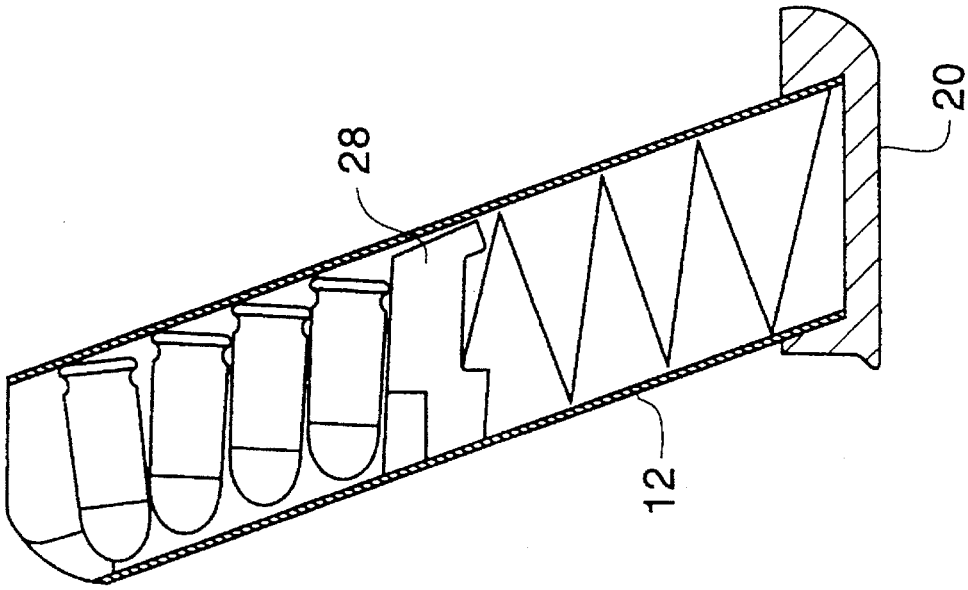
Fig. 3A (PRIOR ART)
FIG. 3A is a side view of an existing extended capacity cartridge magazine illustrating the flow of cartridges through the magazine body.
Figure 4:
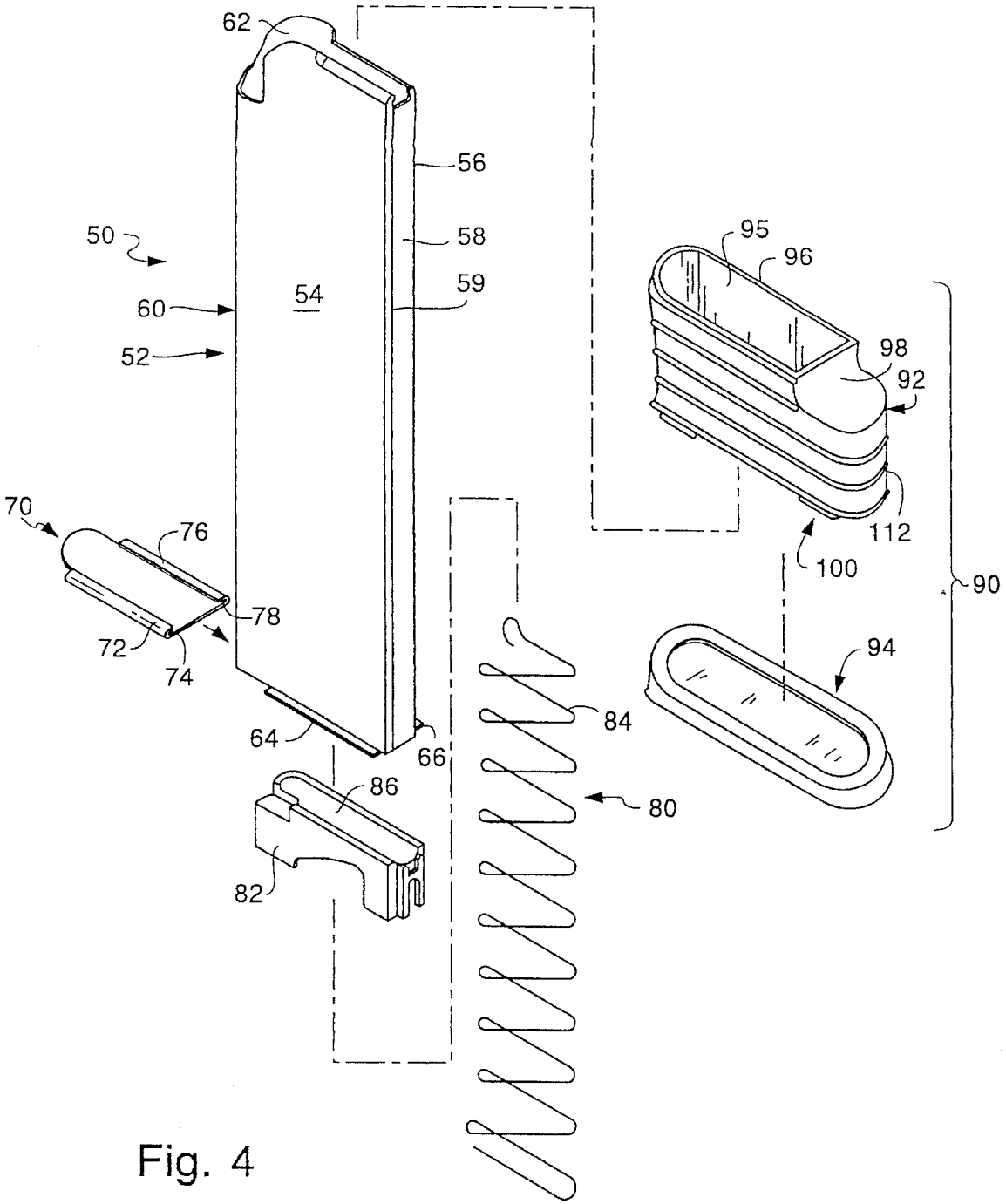
FIG. 4 is an exploded assembly view of the cartridge magazine of the present invention.

Referring now to FIG. 4, the magazine assembly 50 includes a magazine body 52 having a first side wall 54, a second side wall 56, a back wall 58, and a front wall 60. In the disclosed embodiment the front wall 60 is of a substantially rounded configuration which corresponds to the rounded front wall of the well of a 0.45 caliber pistol.

The upper end of magazine body 52 includes an opening 62 through which 0.45 caliber cartridges may be loaded into the magazine for use and may pass from the magazine into the firing chamber of the firearm. A first retaining tab 64 is disposed at the lower end of first side wall 54. Similarly, a second retaining tab 66 is disposed at the lower end of second side wall 56. Base plate 70 includes a first ear 72 defining a first channel 74 and a second ear 76 defining a second channel 78. Base plate 70 is slidably engagable with the lower end of magazine body 52 by sliding the base plate over the bottom of the magazine body 52 and interconnecting guide tracks 64 and 66 with channels 74 and 78, respectively.

The follower assembly 80 includes follower body 82 and compression spring 84. The follower assembly 80 is disposed within the magazine body 52. Compression spring 84 is disposed between follower body 82 and base plate 70 to bias follower body 82 toward the upper end of magazine body 52. The upper surface of follower body 82 includes an indentation 86 for receiving a 0.45 caliber cartridge. To load the magazine, cartridges may be inserted through opening 62 into magazine body 52. As cartridges are successively loaded into magazine body 52 follower body 82 is forced, against the bias provided by compression spring 84, toward base plate 70. Loaded in this manner, the follower assembly 80 continually urges cartridges toward opening 62 for positioning within the firing chamber of the firearm.

Figures 6A, 6B, 6C:
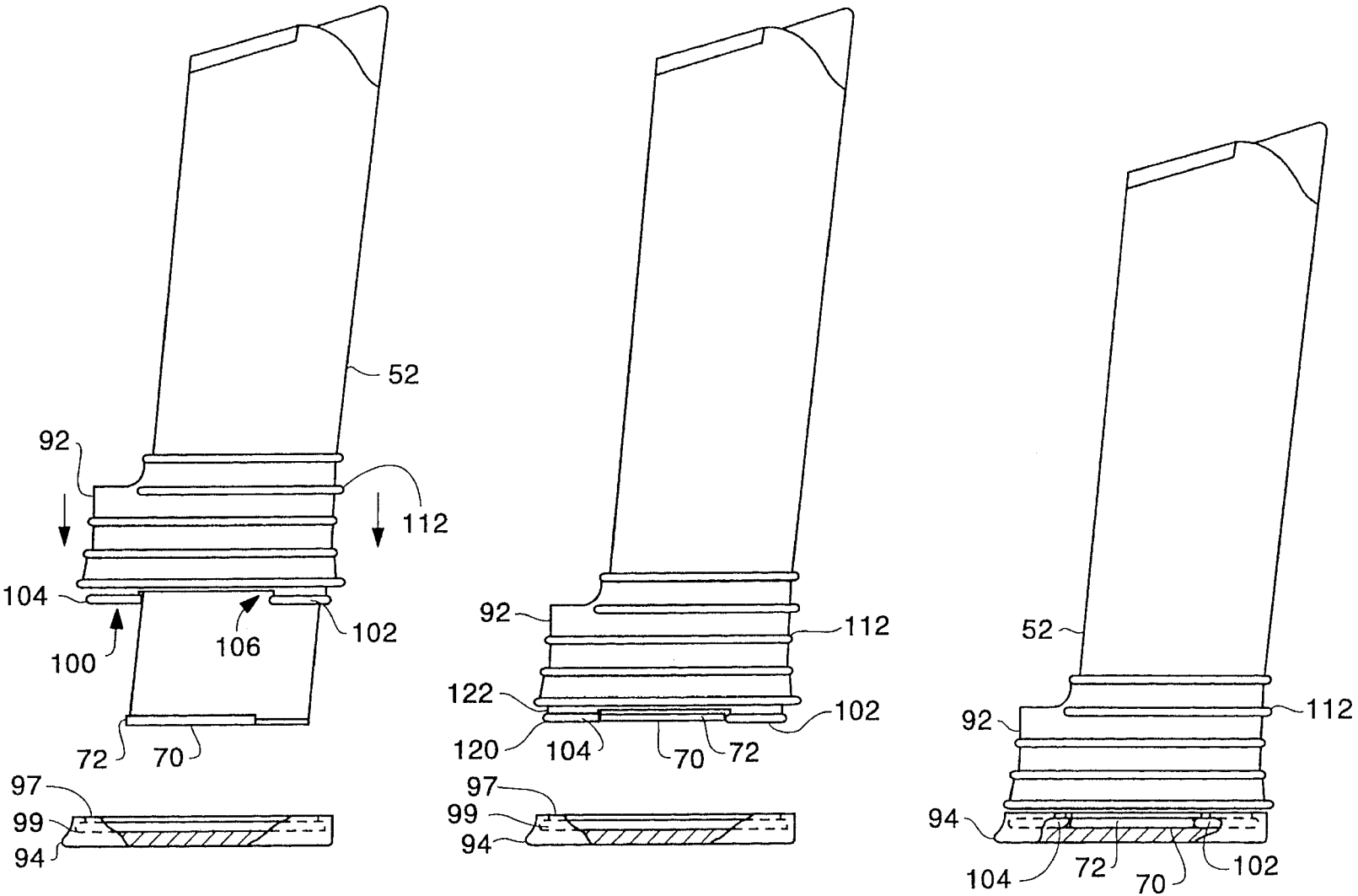
FIG. 6A is a side view of the cartridge magazine of the present invention with the collar being slid toward the lower end of the magazine.
FIG. 6B is a side view of the cartridge magazine of the present invention with the collar in position at the lower end of the magazine.
FIG. 6C is a side view of the cartridge magazine of the present invention with the collar in position at the lower end of the magazine and the bumper plate secured to the collar.

The spacer assembly 90 includes collar 92 and bumper plate 94. Collar 92 includes an interior channel 95 dimensioned and shaped to allow collar 92 to be slidably movable along the length of magazine body 52. Collar 92 further includes an upper surface 96 having a scalloped portion 98 and a lower surface 100. As illustrated in FIG. 6A, lower surface 100 includes a first rim element 102 and a second rim element 104 defining a gap 106 therebetween. As further illustrated in FIGS. 6B and 7, when collar 92 is positioned at the lower end of magazine body 52 the ears 72, 76 of base plate 70 fit securely into the gap 106, thereby preventing base plate 70 from sliding in either direction along guide tracks 64 and 66 and fixably securing base plate 70 in place.

Figure 7:
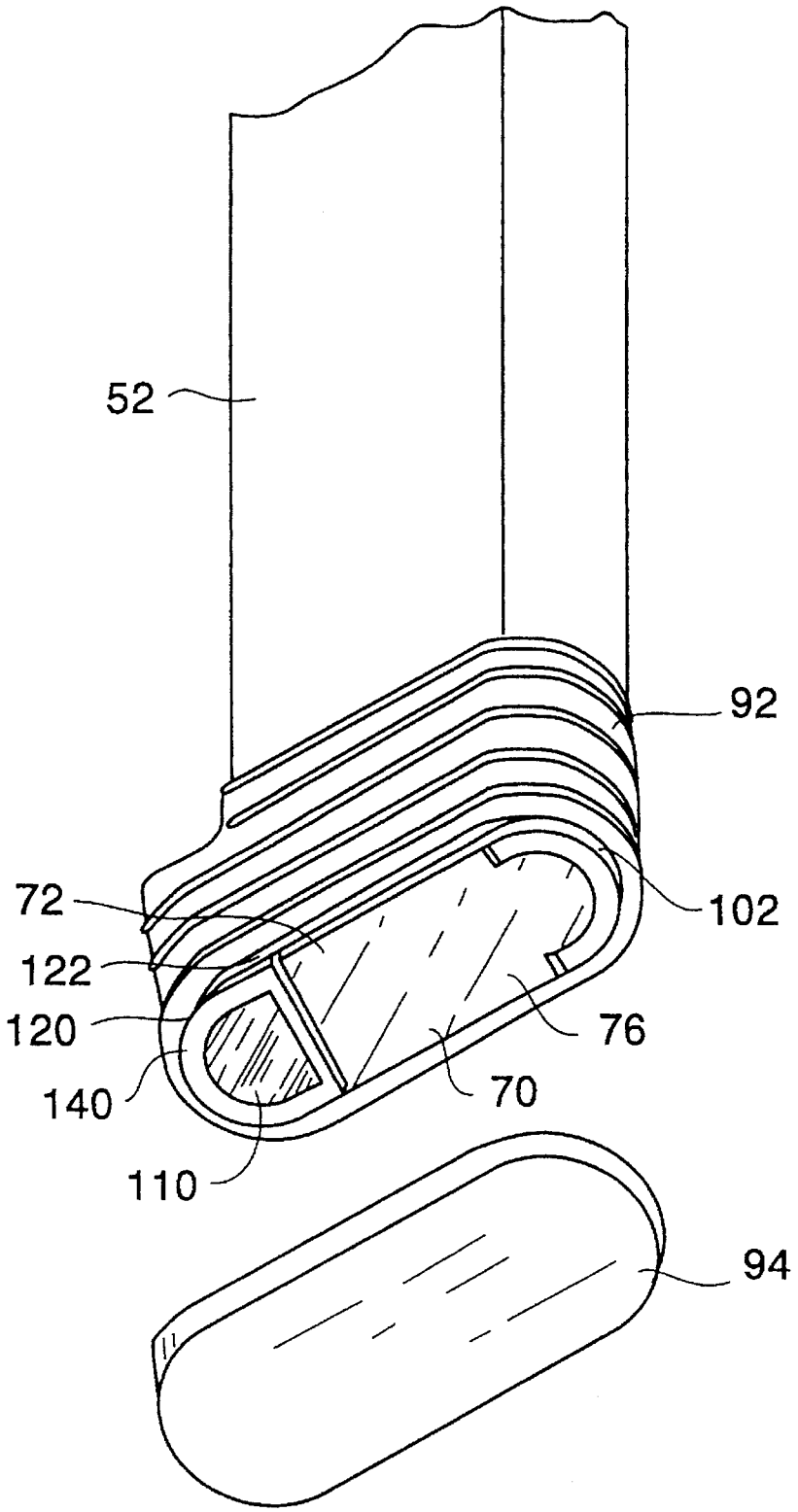
FIG. 7 is a perspective view of the bottom surface of the collar and magazine body illustrating the interconnections therebetween.

As also illustrated in FIG. 6B and FIG. 7, when collar 92 is positioned at the bottom end of magazine body 52 rim elements 102 and 104 cooperate with base plate ears 72 and 76 to form a substantially continuous rim 120 and underlying channel 122 on the bottom surface of collar 92. Bumper plate 94 includes an opposing continuous rim 97 and underlying channel 99 for interlocking with the rim 120 and channel 122 on the bottom surface of collar 92. The magazine assembly 50 is held securely in place by simply snapping the flexible bumper plate 94 over the rim 120 and channel 122 on the bottom surface of collar 92 as shown in FIG. 6C.

Referring now to FIG. 7, collar 92 further includes an internal cavity 110 disposed substantially beneath the scalloped section 98 of upper surface 96. The internal cavity 110 may be used to receive weighted members which facilitate ejecting the magazine assembly 50 from the well of the firearm and which allow the user to adjust the weight and balance of the firearm according to their preference. The side surface of collar 92 also includes a plurality of ribbed members 112 which facilitate gripping the collar 92.

Figure 9C:
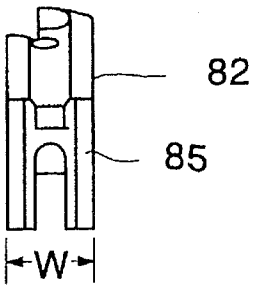
FIG. 9C is a rear elevation view of a follower body in accordance with the present invention.
Figure 9B:
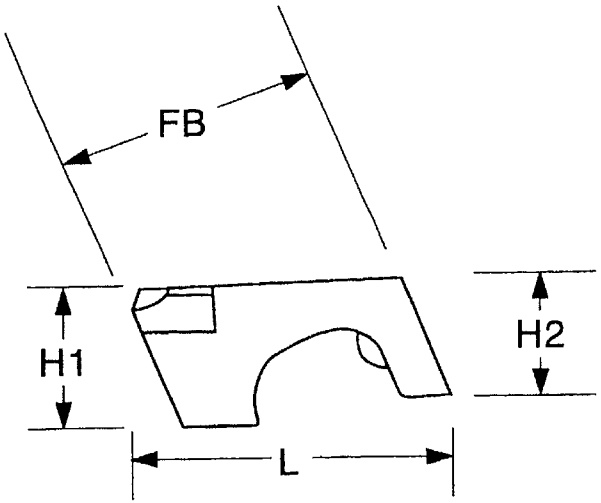
FIG. 9B is a side elevation view of a follower body in accordance with the present invention.
Figure 9A:
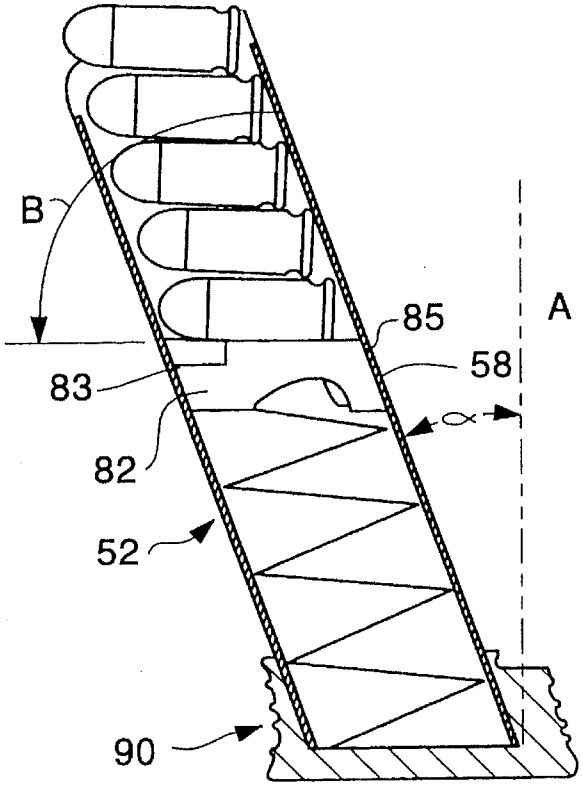
FIG. 9A is a side elevation view of a cartridge magazine body in accordance with the present invention.

Referring now to FIGS. 9A, 9B, and 9C, one feature of the cartridge magazine which facilitates the smooth feeding of cartridges through the magazine body and into the firing chamber will be described. As previously discussed, cartridge magazines for use with pistols typically fit within a well disposed within the grip of the pistol. Most pistol grips are offset from a nominal axis perpendicular to a longitudinal axis through the barrel of the firearm by some angle. Accordingly, to fit within the well of the pistol, cartridge magazines are typically offset from a nominal axis perpendicular to a longitudinal axis along the barrel of the firearm by a cartridge magazine angle, $\alpha$.

In the embodiment illustrated in FIG. 9A, the cartridge magazine body 52 is offset from a nominal axis A perpendicular to a longitudinal axis through the barrel of the firearm by a cartridge magazine angle alpha ($\alpha$) of approximately twenty (e.g. 20) degrees to provide for a proper fit within the well of a 0.45 caliber pistol. To reduce the possibility of the firearm jamming during operation, it has been determined that controlling the angle of the follower relative to the inside walls of the magazine body to a tight rotational tolerance is critical to the reliable function of the magazine. It is important that the follower body 82 and the cartridges remain substantially parallel to a longitudinal axis through the barrel of the firearm when moving through the cartridge magazine 50 and into the firing chamber of the firearm. With respect to maintaining this substantial parallelism, the angle beta (β) of FIG. 9A that the follower body 82 defines relative to the wall of the magazine body must not vary outside a predetermined range. That is, for example, the follower body 82 cannot rotate outside a determined range. If allowed to do so, jamming of cartridges occurs as the cartridges exit the magazine into the firearm. For a 0.45 magazine, with the angle α being a nominal 20° and with the follower body 82 being parallel to the barrel longitudinal axis of the firearm that receives the magazine, the angle β is a nominal 70°. For such a magazine that holds more than seven 0.45 caliber cartridges, it has been determined that it is undesirable to allow the follower body 82 to rotate more than 2° from the nominal 70° in a nose down direction (e.g., the front wall 83 of follower body 82 rotating downwardly relative to the nominal position). For such a magazine that holds ten cartridges, the follower body 82 cannot be permitted to rotate even that amount. The amount of permissible movement in a nose down direction, when ten cartridges are held in the magazine, is no greater than 1.5° and may be as low as 0.5°, but preferably is less than 1°. With respect to a nose up direction (follower rotates clockwise), the permissible movement is less than 4° from the nominal.

To facilitate the smooth flow of cartridges through the magazine body 52 and into the firing chamber of the firearm, the front wall 83 and rear wall 85 of follower body 82 are offset by approximately twenty degrees from an axis perpendicular to a longitudinal axis through the center of follower body 82, as illustrated in FIG. 9B. Offsetting the follower body 82 by about twenty degrees positions the follower body 82 substantially parallel to a longitudinal axis through the barrel of the firearm when the follower body is disposed within the magazine body 52, as illustrated in FIG. 9A. In one embodiment, the follower body 82 is designed having certain dimensions to reduce the possibility that follower body 82 will experience undesirable rotation within magazine body 82. In this regard, the height of the front wall 83 of follower body 82 (dimension H1) is within the range of 0.640–1.640 inches and the height of the back wall 85 of follower body 82 (dimension H2) is within the range of 0.050–1.050 inches. A key dimension of the follower body 82 is the front-to-back (FB) dimension. For 0.45 caliber cartridges, regardless of whether or not they are truncated or non-truncated (rounded), this dimension is critical and must be in the range of 1.305–1.350 inch, where the thickness of the magazine walls is in the range of 0.010–0.030 inch and with the follower angle β being in the range of 68°–72°, preferably 70°. If this FB dimension is not maintained within this range, an unwanted amount of rotation of the follower body 82 takes place and cartridge jamming occurs. That is, within this range, both truncated and non-truncated 0.45 caliber cartridges are able to feed into the firearm without jamming. Outside of this range, at least one of truncated and non-truncated 0.45 caliber cartridges will experience jamming problems. It has been determined that this FB dimension range is critical and must be maintained in order to limit the nose-down rotation of follower body 82 within the cartridge magazine body 52 to less than about one-half degree (0.5°).

Referring to FIG. 9C, the width of follower body 82 (dimension W) is specified as falling within a critical range from 0.458 inch to 0.465 inch, inclusive, with a tolerance of ±0.005 inch, to limit the side-to-side rotation of follower body 82 within magazine body 52. The stability of follower body 82 as it moves relative to magazine body 52 facilitates the smooth feeding of cartridges through the magazine to the firearm and reduces the likelihood of the firearm jamming during operation.

Figure 5B:
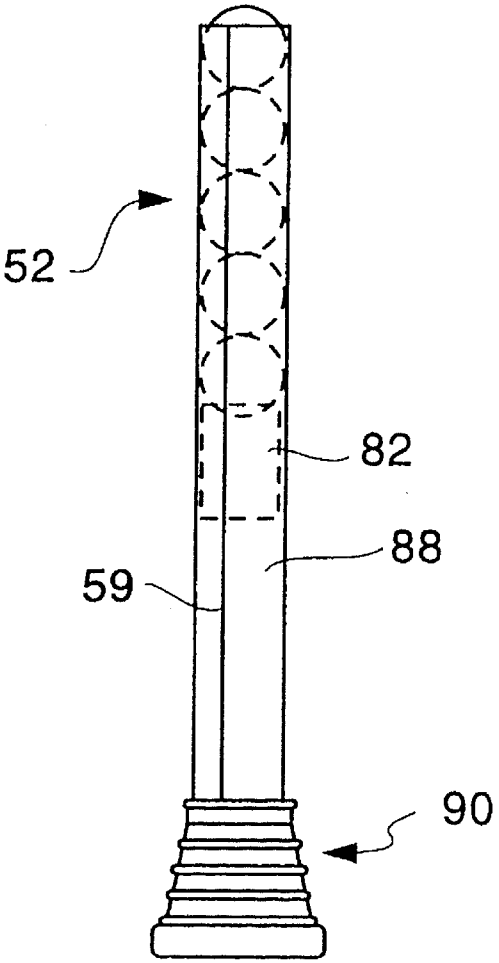
FIG. 5B is a rear view of an extended capacity cartridge magazine of the present invention.
Figure 5A:
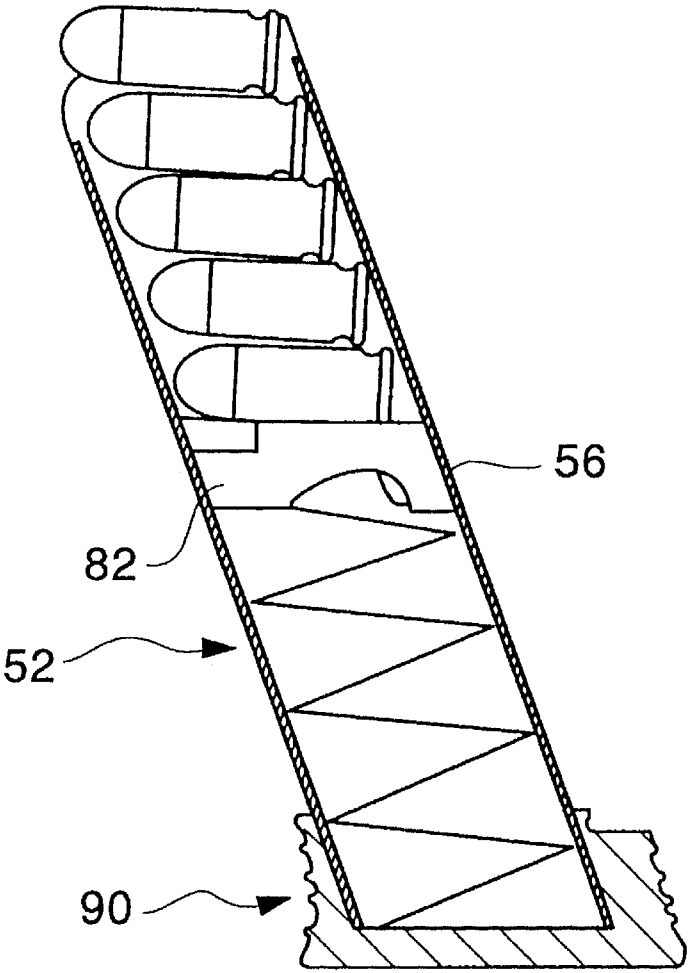
FIG. 5A is a side view of an extended capacity cartridge magazine of the present invention illustrating the flow of cartridges through the magazine body.

Referring now to FIGS. 5A and 5B, another feature of the present invention which facilitates the smooth flow of cartridges through the magazine will be described. As illustrated in FIG. 5A, cartridges move relatively upwardly and forwardly within cartridge magazine body 52 during operation. As previously discussed, surface imperfections associated with the weld line of the magazine body have contributed to jamming of cartridges in existing magazines. To alleviate this problem, the weld line 59 of the present invention has been offset from the center of the back wall 58 of the cartridge magazine body 52, as illustrated in FIG. 5B, to avoid contact between any surface irregularities associated with the weld line 59 and the rims of cartridges disposed within magazine body 52 which may interfere with the smooth feeding of cartridges through magazine body 52. In the disclosed embodiment, the weld line 59 is offset by approximately one-eighth (0.125) inch, however it should be appreciated that the exact distance is not critical provided it is sufficient to avoid contact between any surface irregularities associated with the weld line 59 and the rims of cartridges disposed within magazine body 52.

Advantageously, because of the snap-together design no tools are required to assemble or disassemble the magazine assembly 50. The magazine assembly 50 may be assembled by first placing the follower body 82 and compression spring 84 within the magazine body 52 as indicated in FIG. 4 and sliding the base plate 70 into place over bottom end of magazine body 52 using the interfitting guide tracks 64, 66 and channels 74, 78. Next the collar 92 is mounted on the magazine body 52 by sliding the collar 92 from the upper end of magazine body 52 to the bottom end of magazine body 52 as indicated in FIGS. 4A and 4B. Finally, as illustrated in FIG. 6C, the magazine assembly 50 is completed by securing base plate 94 to the collar 92 using the interlocking rim and channel configuration described above.

Figure 8A:
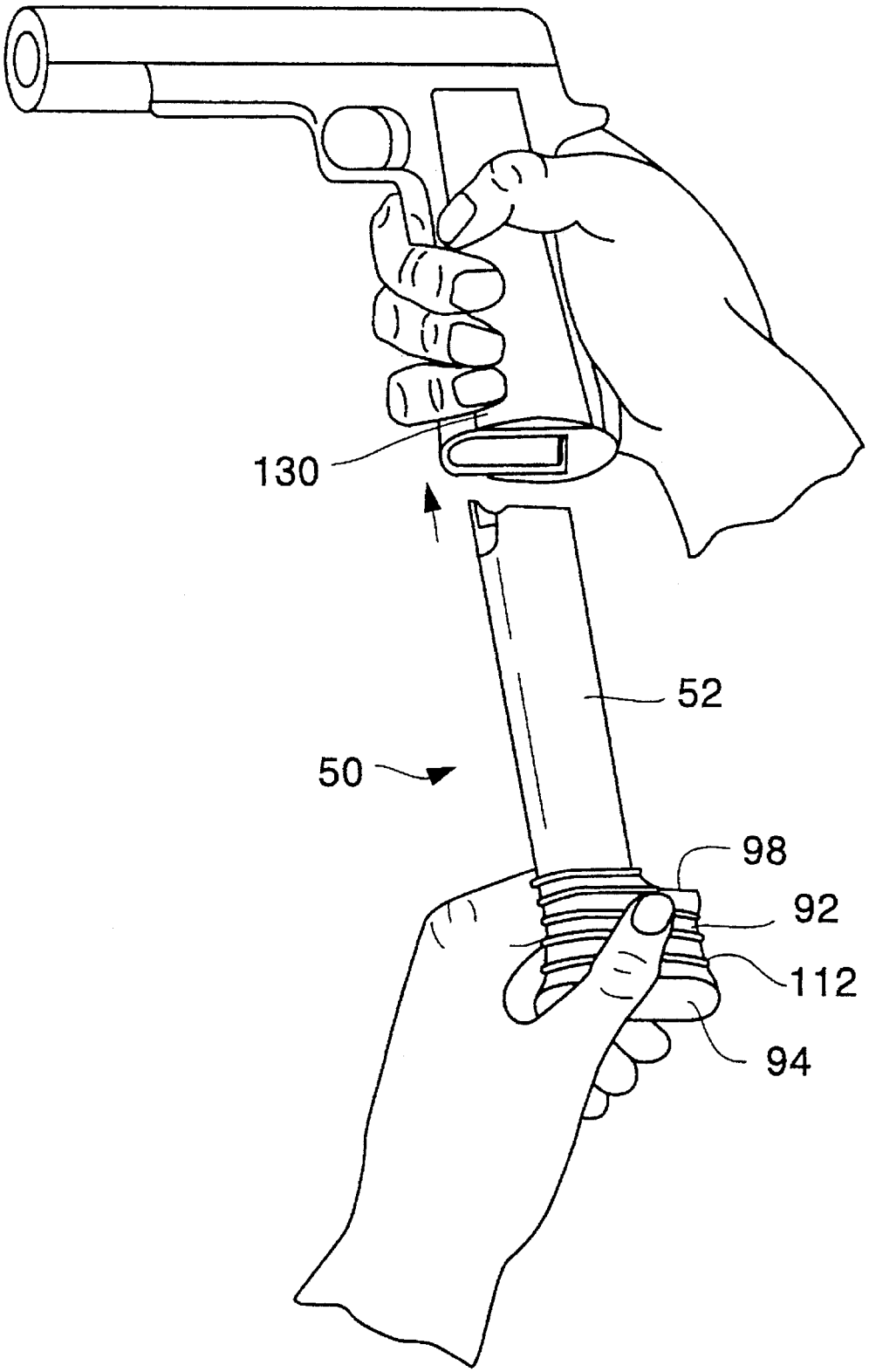
FIG. 8A is a perspective view of a cartridge magazine of the present invention positioned for insertion into a firearm.
Figure 8C:
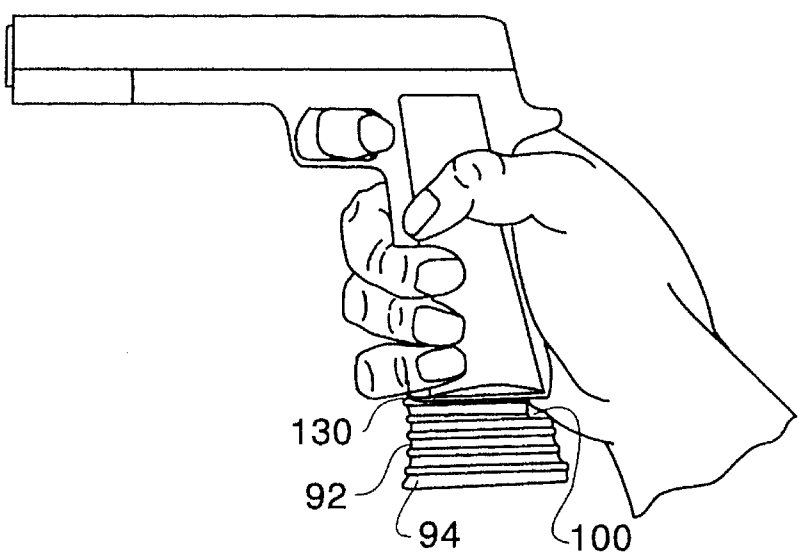
FIG. 8C is a perspective view of a cartridge magazine of the present invention completely engaged within the well of a firearm.
Figure 8B:
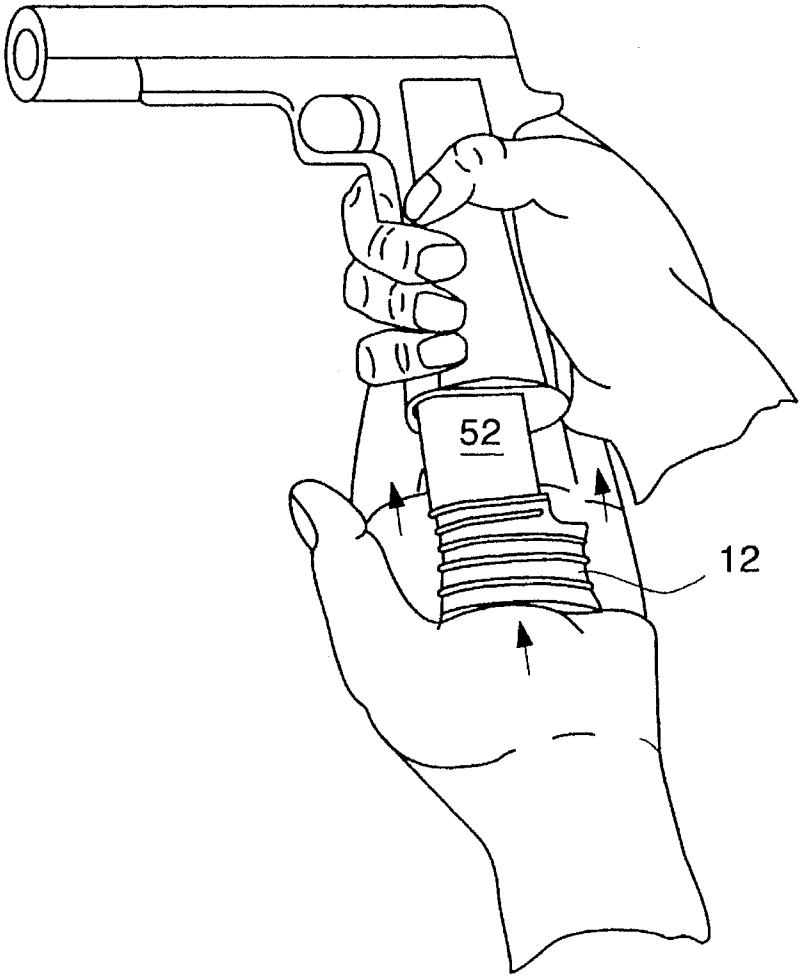
FIG. 8B is a perspective view of a cartridge magazine of the present invention partially inserted into a firearm.

As illustrated in FIGS. 8A–8C, the magazine assembly 50 may be engaged for use with a 0.45 caliber pistol by first positioning the magazine for insertion as illustrated in FIG. 8A and then inserting the upper end of magazine body 52 into the well of the pistol as illustrated in FIG. 8B. As noted above, the user must apply a force to the base plate 94 of the magazine assembly sufficient to overcome the resistance of the spring biasing mechanism in the well of the pistol. As best illustrated in FIG. 8C, the scalloped portion 98 of collar 92 defines a space 100 between the collar 92 and the base of the handle 130 when the magazine is disposed within the well of the pistol. This space 100 reduces the possibility of pinching the palm of the hand holding the pistol between the collar 92 and the base of the handle 130 when loading the magazine into the pistol.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A magazine for housing cartridges, comprising:

a magazine body having an upper outlet end from which cartridges exit said magazine body and lower end portions with a bottom end opposite from said upper end;

a follower assembly for use in moving cartridges relative to said magazine body; and a spacer assembly located at said bottom end of said magazine body, said spacer assembly including a collar and a bumper plate, said collar having an upper surface and a lower surface and having a height defined between said upper surface and said lower surface and a majority of said height surrounding said lower end portions of said magazine body, said lower surface being connected to said bumper plate by frictional engagement with upper portions of said bumper plate being in an overlapped relationship with lower portions of said spacer assembly.

2. A magazine, as claimed in claim 1, wherein:

said magazine body includes a base plate connected at said bottom end of said magazine body that covers at least portions of said bottom end of said magazine body.

3. A magazine, as claimed in claim 1, wherein:

said magazine body includes a base plate having first and second ears and said spacer assembly includes a collar having a lower rim with said lower rim preventing said base plate from being removed from said magazine body.

4. A magazine, as claimed in claim 3, wherein:

each of said first and second ears has a channel and said bottom end of said magazine body includes first and second guide tracks and wherein said first and second guide tracks are disposed in said channels of said first and second ears, respectively.

5. A magazine, as claimed in claim 1, wherein:

said magazine body includes a movable base plate connected to said bottom end of said magazine body and said spacer assembly includes a collar and a separable bumper plate, with said bumper plate connected to said collar adjacent said base plate for use in preventing movement of said base plate.

6. A magazine, as claimed in claim 1, wherein:

said spacer assembly includes a collar having a groove and a rim located at a lower end of said collar and said spacer assembly also includes a bumper plate having a periphery and a hollow interior and wherein said periphery is positioned about said groove and said rim.

7. A magazine, as claimed in claim 1, wherein:

said spacer assembly includes a collar having a scalloped section that is used to define a space between a bottom end of a firearm and said scalloped section when said magazine is connected to the firearm to reduce the possibility of pinching the palm of the hand holding the firearm when inserting said magazine into the firearm.

8. A magazine, as claimed in claim 7, wherein:

said spacer assembly also includes a lateral extender section having a cavity for receiving weighted members for use in adjusting the weight experienced by the shooter when using the firearm.

9. A magazine, as claimed in claim 1, wherein:

said magazine body includes a first material, said collar includes a second material and said bumper plate includes a third material.

10. A magazine, as claimed in claim 1, wherein:

said magazine body has a first material that includes metal, said spacer assembly includes a collar made of a second material that includes a substantially rigid plastic and said spacer assembly includes a bumper plate that is made from a third material that includes a flexible material.

11. A magazine for housing cartridges, comprising:

a magazine body having an upper outlet end from which cartridges exit said magazine body and lower end portions with a bottom end opposite from said upper end, said magazine body further including a movable base plate connected to said bottom end of said magazine body;

a follower assembly for use in moving cartridges relative to said magazine body; and a spacer assembly located at said bottom end of said magazine body, said spacer assembly including a collar with an upper surface and a lower surface and having a height defined between said upper surface and said lower surface and a majority of said height surrounding said lower end portions of said magazine body, and a separable bumper plate, with said bumper plate connected to said collar adjacent said base plate for use in preventing movement of said base plate.

12. A magazine, as claimed in claim 11, wherein:

said collar has a rim that includes at least a first gap and said base plate has a first ear that is disposed in said first gap for use in holding said base plate in place.

13. A magazine, as claimed in claim 11, wherein:

at least portions of said spacer assembly are made from a material different from the material from which said magazine body is made

14. A magazine, as claimed in claim 11, wherein:

said magazine body includes a first material having metal and said spacer assembly includes a second material having plastic.

15. A magazine, as claimed in claim 11, wherein:

said spacer assembly includes a collar having a body outer surface and with spaced ribs disposed about said body outer surface.

16. A magazine, as claimed in claim 11, wherein:

said spacer assembly includes a collar having a bore having dimensions for receiving a width of said magazine body and said collar having a height at least equal to twice the diameter of a 0.45 caliber cartridge.

17. A magazine for housing cartridges, comprising:

a magazine body having an upper outlet end from which cartridges exit said magazine body and lower end portions with a bottom end opposite from said upper end;

a follower assembly for use in moving cartridges relative to said magazine body; and a spacer assembly located at said bottom end of said magazine body, said spacer assembly including a collar with an upper surface and a lower surface and having a height defined between said upper surface and said lower surface and a majority of said height surrounding said lower end portions of said magazine body, said collar having a groove and a rim located at a lower end of said collar, and said spacer assembly also including a bumper plate having a periphery and a hollow interior wherein said periphery is positioned about said groove and said rim.

* * * * *